US007831436B2

(12) United States Patent
Kim et al.

(10) Patent No.: US 7,831,436 B2
(45) Date of Patent: Nov. 9, 2010

(54) APPARATUS FOR DECODING AUDIO DATA WITH SCALABILITY AND METHOD THEREOF

(75) Inventors: Hun Joong Kim, Seoul (KR); Yeong Uk Ahn, Kyeonggi-do (KR); Jae Mi Bahn, Seoul (KR)

(73) Assignee: Core Logic Inc., Seoul (KR)

( * ) Notice: Subject to any disclaimer, the term of this patent is extended or adjusted under 35 U.S.C. 154(b) by 960 days.

(21) Appl. No.: 11/626,491

(22) Filed: Jan. 24, 2007

(65) Prior Publication Data

US 2007/0171990 A1 Jul. 26, 2007

(30) Foreign Application Priority Data

Jan. 26, 2006 (KR) ..... 10-2006-0008252

(51) Int. Cl.
*G10L 19/00* (2006.01)

(52) U.S. Cl. ..... 704/501; 704/500; 704/502

(58) Field of Classification Search ..... 704/501, 704/500, 502

See application file for complete search history.

(56) References Cited

U.S. PATENT DOCUMENTS 6,108,625 A * 8/2000 Kim ..... 704/229
6,148,288 A * 11/2000 Park ..... 704/500
6,529,604 B1 * 3/2003 Park et al. ..... 381/22
2005/0163323 A1 * 7/2005 Oshikiri ..... 381/22

* cited by examiner

*Primary Examiner*—Qi Han
(74) *Attorney, Agent, or Firm*—Foley & Lardner LLP

(57) ABSTRACT

An apparatus for decoding audio data that is capable of reducing the amount of calculations that are performed during the arithmetic decoding of an audio signal coded by bit sliced arithmetic coding (BSAC) to improve the performance of a decoder and a method thereof are provided. According to the embodiments of the present invention, it is possible to reduce the amount of calculations that are performed during the arithmetic decoding of an audio signal in the BSAC to 1/16 of the amount of calculations of the conventional full search method

9 Claims, 6 Drawing Sheets

APPARATUS FOR DECODING AUDIO DATA WITH SCALABILITY AND METHOD THEREOF

This nonprovisional application claims priority under 35 U.S.C. §119(a) on Patent Application No. 10-2006-0008252 filed in Republic of Korea on Jan. 26, 2006, the entire contents of which are hereby incorporated by reference.

BACKGROUND OF THE INVENTION

1. Field of the Invention

The present invention relates to an apparatus for decoding audio data and a method thereof, and more particularly, to an apparatus for decoding audio data with scalability and a method thereof.

2. Description of the Background Art

Bit sliced arithmetic coding (BSAC) is suggested as a moving picture experts group (MPEG) 4 audio compressing method obtained by partially improving the performance of an advanced audio coding (AAC) compressing method.

In the BSAC, a transmitting end codes a signal to an audio signal of a base layer and an audio signal of an enhancement layer. In a receiving end, a user who has a low quality decoder decodes only the audio signal of the base layer to reproduce a basic audio signal and a user who has a high quality decoder adds the audio signal of the enhancement layer to the audio signal of the base layer to reproduce a high quality audio signal.

In such a method, the MPEG-4 introduces a fine grain scalability (FGS) method of transmitting the audio signal of each layer in units of bit planes in order to make it unnecessary to await until the receiving end receives the entire bit stream transmitted by the transmitting end and to let the received audio signal restored using only the bit stream received until then even when the receiving end does not receive the entire bit stream transmitted by the transmitting end.

The FGS is a compression transmitting method in which decoding can be performed by only a partial bit stream of the entire bit stream. In the FGS, the audio signal to be transmitted to the receiving end is divided by bit planes so that the most significant bit (MSB) is coded to be first transmitted. Then, the next significant bit is divided by bit planes to be coded and to be continuously transmitted.

FIG. 1 illustrates the structure of a bit stream in accordance with a conventional audio coding method.

Referring to FIG. 1, the frame of a bit stream is coded so that a quantization sample and side information are mapped to a layer structure for the FGS. That is, in the layer structure, the bit stream of a lower layer is comprised in the bit stream of an upper layer and side information items required for each layer are divided by layer to be coded.

In the head of the bit stream, a header region in which header information is stored is provided, information on a layer 0 is packed, and information items on layers 1 to N (N is an integer larger than or equal to 1) that are enhancement layers are packed in the order. From the header region to the information on the layer 0 is referred to as a base layer. From the header region to the information on the layer 1 is referred to as the layer 1. From the header region to the information on the layer 2 is referred to as the layer 2. In the same manner, from the header region to the information on the layer N, that is, from the base layer to the layer N that is the enhancement layer is referred to as a top layer. Side information and a coded audio signal are stored as information on each layer. For example, side information 2 and coded quantization samples are stored as the information on the layer 2.

In such a structure, the decoder of the receiving end does not always decode the bit rate compressed by the decoder of the transmitting end in the same bit rate but decodes the bit rate in units of 1 kbps so that the encoding bit rate of a target layer that is one of the enhancement layers is used as the maximum bit rate and the bit rate of the base layer is used as the minimum bit rate.

FIG. 2 illustrates a full search method of obtaining the maximum significance value max_snf in a conventional audio decoding method.

The receiving end receives the bit stream illustrated in FIG. 1 to perform arithmetic decoding on each frame. FIG. 2 illustrates a full search method of searching the maximum significance value max_snf required for determining whether the arithmetic decoding is required for an arbitrary layer among the base layer to the top layer.

Even when the arithmetic decoding is required by the maximum significance value max_snf, the current significance value current_snf of each frequency component of the audio signal is examined to determine whether the arithmetic decoding is required.

However, the full search method is used for all of the searches made herein, that is, the search of the maximum significance value max_snf and the comparison between the current significance value current_snf and the maximum significance value max_snf.

For example, when it is assumed that a frequency search range is 510, that the number of channels is 2, and that the number of window groups is 8 as illustrated in FIG. 2, the number of times of comparison to be performed in order to find the maximum significance value max_snf is 510*2*8=8,160 per a layer, which is performed on each frame by the number of layers. For example, when the number of base sub layers base_sublayer is 10 and the number of layers is 48, the comparison must be performed 8,160*58=473,280 number of times.

As described above, a method of comparing all of the current significance values current_snf with all of the coefficients to find the largest value in order to find the arbitrary maximum significance value max_snf in an arbitrary frequency search range is referred to as the full search method.

In the full search method, the amount of calculations per a frame for finding the maximum significance value max_snf is 'the frequency search range*the number of channels*the number of window groups*the number of layers'. In such a method, since the current significance value current_snf must be compared with the coefficients to find the maximum significance value max_snf in each layer, channel, window group, and frequency search range, the amount of unnecessary operations increases to deteriorate the performance of the decoder and to increase cost.

SUMMARY OF THE INVENTION

Accordingly, the present invention has been made in an effort to provide an audio signal decoding apparatus that is capable of reducing the amount of calculations that are performed during the arithmetic decoding of an audio signal in bit sliced arithmetic coding (BSAC) to 1/16 of the amount of calculations of a conventional full search method to improve the performance of a decoder and to reduce cost and a method thereof.

The present invention now will be described with reference to embodiments of the invention. This invention may, however, be embodied in many different forms and should not be construed as being limited to the embodiments set forth herein; rather, these embodiments are provided so that this disclosure will be thorough and complete, and will fully convey the concept of the invention to those skilled in the art.

According to an embodiment of the present invention, there is provided an apparatus for decoding audio data coded to have a layer structure so that a bit rate can be controlled from a base layer to a target layer. The apparatus comprises a bit plane decoder for decoding side information on each layer to obtain the current significance values of symbols that belong to each layer and for decoding the symbols in units of coding bands in the order of from the symbol composed of the uppermost bits to the symbol composed of the lowermost bits with reference to the maximum significance value of each layer to obtain quantization samples and an operating unit for binding the current significance values in units of the coding bands to form a significance search tree in units of the coding bands and to obtain the maximum significance value of each layer using the significance search tree.

The apparatus may further comprise an inverse quantizing unit for inverse quantizing the quantization samples based on the side information to restore the inverse quantized quantization samples to an audio signal of an original size, a frequency/time mapping unit for converting the restored audio signal from a frequency domain to a time domain, and a frame buffer in which the significance search tree is stored and updated.

The operating unit obtains the maximum significance value of each layer using the significance search tree and a full search method for a predetermined frequency search range.

The amount of calculations per a frame that are performed by the operating unit is obtained by multiplying the sum of the number of coding bands of each layer and the frequency search range to which the full search method is applied, the number of channels, the number of window groups, and the number of layers by each other.

In the bit plane decoding unit, differential decoding is performed on the side information and arithmetic decoding is performed on the symbols.

According to an embodiment of the present invention, there is provided a method of decoding an audio signal coded to have a layer structure so that a bit rate can be controlled from a base layer to a target layer. The method comprises obtaining the maximum significance value of a reference layer that is one of the base layer to the target layer using a significance search tree in units of coding bands, comparing the maximum significance value with the minimum significance value to determine whether arithmetic decoding is to be performed, searching the decoding positions of the symbols while comparing the current significance values of the symbols that belong to the reference layer with the maximum significance value when it is determined that the maximum significance value is larger than or equal to the minimum significance value, performing arithmetic decoding on the symbols in units of the coding bands, checking coding bands on which the arithmetic decoding is performed to update the significance search tree, and repeating the obtaining of the maximum significance value of a reference layer to the checking of coding bands on which the arithmetic decoding is performed while reducing the maximum significance value by 1 until the maximum significance value is smaller than the minimum significance value.

In the searching the decoding positions of the symbols, the searching uses the significance search tree.

In the obtaining of the maximum significance value of a reference layer, the maximum significance value of each layer is obtained using the significance search tree and a full search method for a predetermined frequency range.

In the obtaining of the maximum significance value of a reference layer, the amount of calculations per a frame is obtained by multiplying the sum of the number of coding bands of each layer and the frequency search range to which the full search method is applied, the number of channels, the number of window groups, and the number of layers by each other.

BRIEF DESCRIPTION OF THE DRAWINGS

The advantages of the present invention will become more apparent by describing in detail embodiments thereof with reference to the attached drawings in which like numerals refer to like elements.

DETAILED DESCRIPTION OF EMBODIMENTS

Embodiments of the present invention will be described in a more detailed manner with reference to the drawings.

Figure 3:
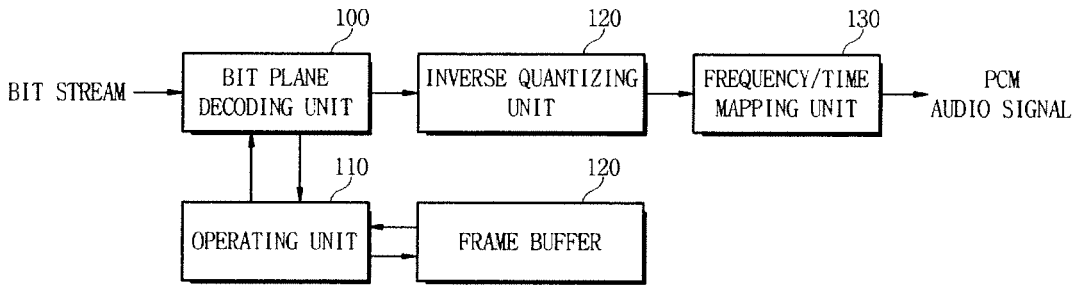
FIG. 3 is a block diagram illustrating an apparatus for decoding audio data according to an embodiment of the present invention.

FIG. 3 is a block diagram illustrating an apparatus for decoding audio data according to an embodiment of the present invention, in which an example of an apparatus for decoding audio data coded to have a layer structure using bit sliced arithmetic coding (BSAC) so that a bit rate can be controlled from a base layer to a target layer.

A bit plane decoding unit 100 receives a bit stream coded to have a layer structure, decodes side information on each layer to obtain the current significance values current_snf of the symbols of each layer, and decodes the symbols in units of coding bands in the order of from the symbol composed of the uppermost bits to the symbol composed of the lowermost bits to obtain quantization samples with reference to the maximum significance value max_snf of each layer. At this time, differential decoding is performed on the side information and arithmetic decoding is performed on the symbols.

An operating unit 110 binds current significance values current_snf in units of coding bands to form a significance search tree in units of coding bands and to obtain the maximum significance value max_snf of each layer using the significance search tree.

Figure 5:
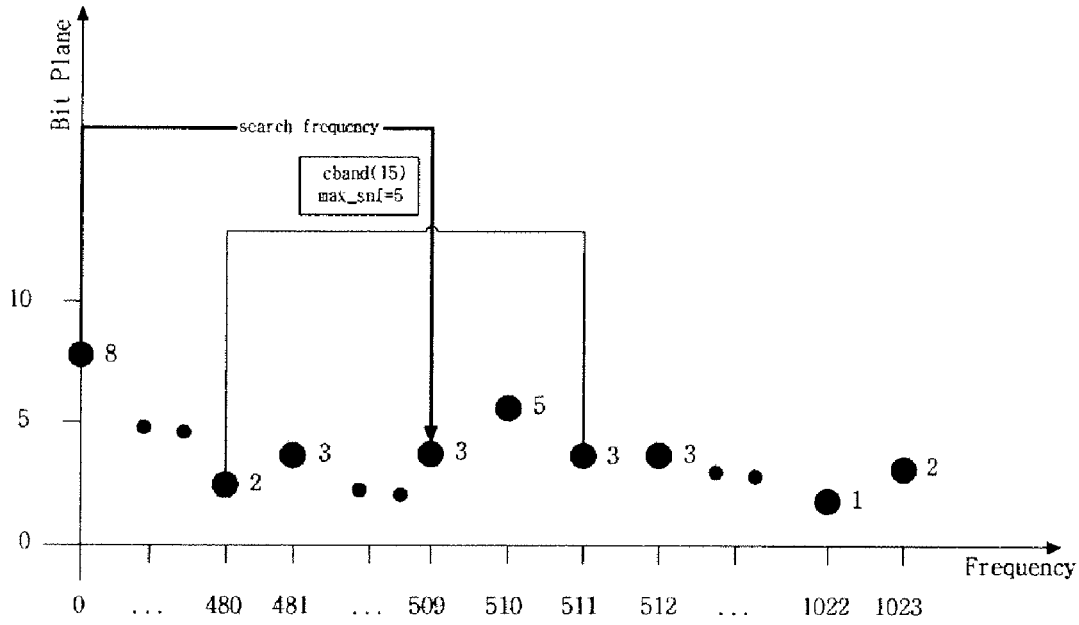
FIG. 5 illustrates a part of FIG. 4 in detail.

Also, the operating unit 110 may obtain the maximum significance value max_snf of each layer using the significance search tree and a full search method for a predetermined frequency search range (refer to FIG. 5).

At this time, the amount of calculations per a frame that is performed by the operating unit 110 is obtained by multiplying the number of coding bands cband_range of each layer, the sum of search frequencies to which the full search method is applied full_search_range, the number of channels, the number of window groups window_group, and the number of layers by each other.

An inverse quantizing unit 120 inverse quantizes the quantization samples based on the side information to restore the inverse quantized quantization samples to an audio signal of an original size.

A frequency/time mapping unit 130 converts the restored audio signal from a frequency domain to a time domain to output a pulse code modulation (PCM) audio signal of the time domain.

The significance search tree is stored in a frame buffer 140 and, when the arithmetic decoding is performed on an arbitrary coding band, the intermediate significance value of the corresponding coding band cband_snf is updated so that the significance search tree is updated.

Figure 4:
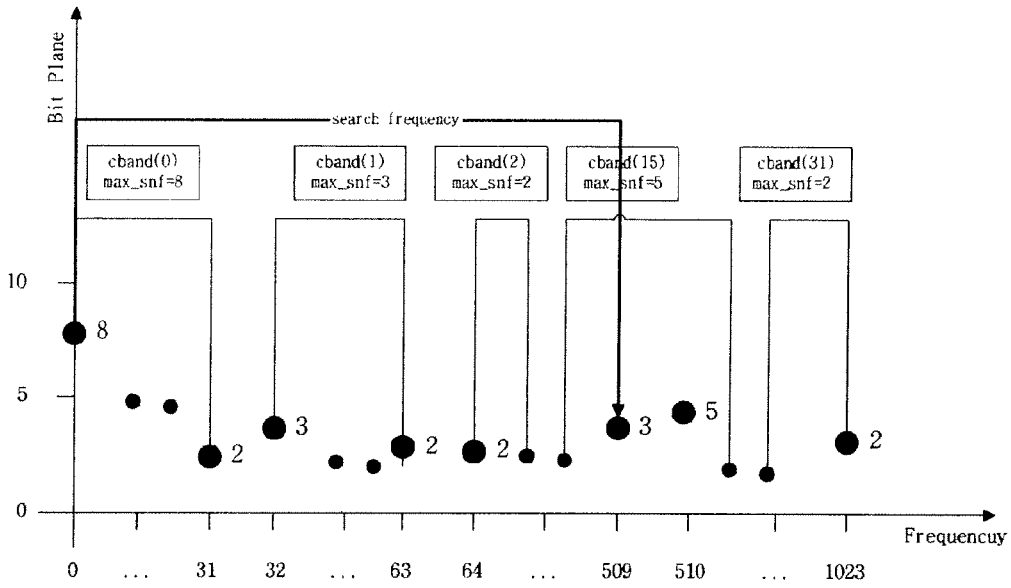
FIG. 4 illustrates the structure of a significance search tree for obtaining the maximum significance value by the apparatus for decoding audio data according to an embodiment of the present invention.

FIG. 4 illustrates the structure of the significance search tree for obtaining the maximum significance value by the apparatus for decoding audio data according to an embodiment of the present invention. FIG. 5 illustrates a part of FIG. 4 in detail.

Figure 1:
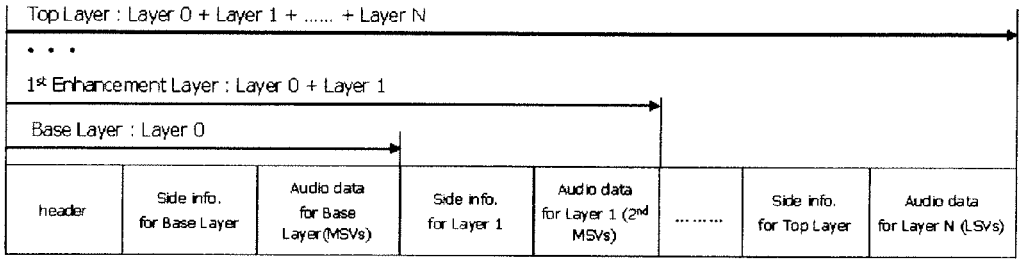
FIG. 1 illustrates the structure of a bit stream in a conventional audio coding method.
Figure 2:
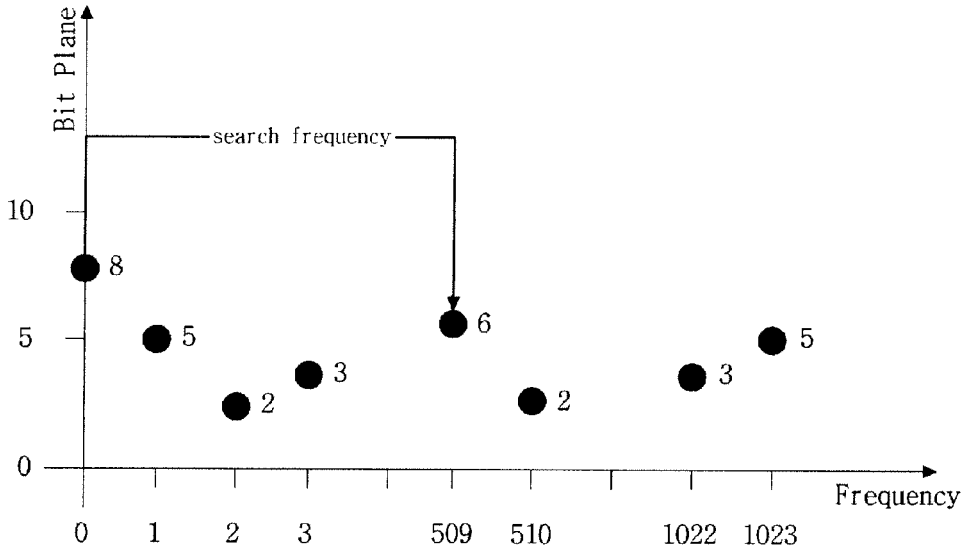
FIG. 2 illustrates a full search method of obtaining the maximum significance value in a conventional audio decoding method.

The conventional full search method as illustrated in FIG. 2 may be changed to have the tree structure as illustrated in FIG. 4. FIG. 4 illustrates a case in which the present invention is applied to the conventional full search method of FIG. 2.

In the BSAC, decoding is performed in units of coding bands (a coding band has 32 sub bands). According to the present invention, the significance search tree is made in units of the coding bands so that the maximum significance value max_snf for the intermediate significance value cband_snf of each coding band is stored in the frame buffer 140 and that searching is performed in units of the intermediate significance values cband_snf.

In the example of FIG. 4, since a frequency search range between 0 and 509 is provided, the number of intermediate significance values is between 0 and 14 in a frequency search range between 0 and 479 so that the maximum significance value max_snf can be searched in units of coding bands. However, since the entire section of the cband (15) that is the final coding band is not comprised in frequencies between 480 and 509 that exist in the frequency search range, it is not possible to obtain the correct maximum significance value max_snf.

Therefore, when the maximum significance value max_snf for the section in the frequency search range full_search_range between 480 and 509 is obtained by the full search method as illustrated in FIG. 5, it is possible to correctly obtain the desired value.

The case of FIGS. 4 and 5 is compared with the case of FIG. 2 to calculate reduction in the amount of calculations as follows. First, let's assume that the number of coding bands cband_range to be searched by the significance search tree structure is 15, that the number of frequencies to which the full search method is applied is 30, that the number of channels is 2, and that the number of window groups window_group is 8. Then, the number of times of comparison to be performed in order to find the maximum significance value max_snf is (15+30)*2*8=720 per a layer, which is performed on each frame by the number of layers. For example, when it is assumed that the number of base sub layers base_sublayer is 10 and that the number of layers is 48, the comparison is performed by 720*58=41,760 number of times. Therefore, it is possible to obtain the same result as the result of the conventional full search method with the amount of calculations less than 1/10 of the amount of calculations of the conventional full search method.

However, the amount of calculations per a frame according to the present invention is '(cband_range+partial_full_search_range)*channel*window_group*layer'. Here, the frequency search range is between 1 and 1024, the cband_range is between 1 and 32, and the partial_full_search_range is between 1 and 32.

Therefore, meanwhile the search range is 1024 in the worst case in the conventional full search method, the cband_range+partial_full_search_range is 64 in the worst case in the significance search tree according to the present invention under the same conditions so that calculations that amount to 1/16 of the amount of calculations of the full search method are required.

In the significance search tree structure, the intermediate significance values cband_snf must be updated after the arithmetic decoding is performed. However, since only the intermediate significance values cband_snf of the coding bands on which the arithmetic decoding is performed in the entire frequency search range are updated, the amount of calculations hardly increases.

Figure 6:
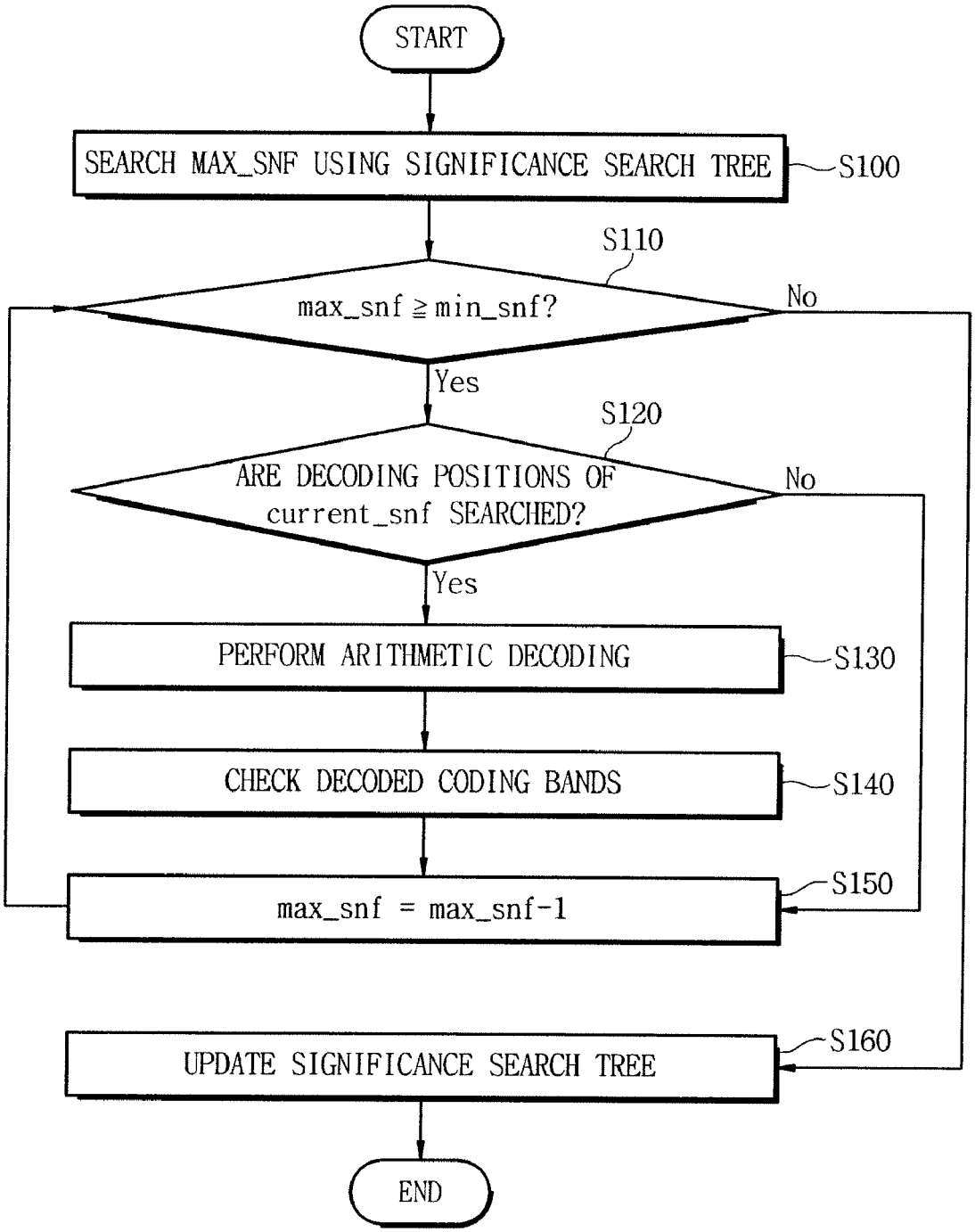
FIG. 6 is a flowchart illustrating the audio decoding method according to an embodiment of the present invention.

FIG. 6 is a flowchart illustrating the audio decoding method according to an embodiment of the present invention.

First, in S100, the maximum significance value max_snf of a reference layer that is one of a base layer to a target layer is obtained by using the significance search tree in units of coding bands. In S110, the maximum significance value max_ snf is compared with the minimum significance value min_snf to determine whether the arithmetic decoding is to be performed.

When the maximum significance value max_snf is larger than or equal to the minimum significance value min_snf, the process proceeds to S120 so that the decoding positions of symbols are searched while comparing the current significance values current_snf of the symbols that belong to the reference layer with the maximum significance value max_snf.

Then, it is determined whether the arithmetic decoding is required for the current layer in accordance with the search result. Even when the arithmetic decoding is required by the maximum significance value max_snf, the current significance values current_snf of the coefficients of the symbols are examined to determine whether the arithmetic decoding is required. When it is determined that the arithmetic decoding is required, the process proceeds to S130. When it is determined that the arithmetic decoding is not required, the process proceeds to S150.

When the maximum significance value max_snf is smaller than the minimum significance value min_snf, the process proceeds to S160 so that the significance search tree is updated for the coding bands on which the arithmetic decoding is performed in each frame.

Next, in S130, after the arithmetic decoding is performed on the symbols in units of the coding bands, in S140, the coding bands on which the arithmetic decoding is performed are checked so that a coding band range for updating the significance search tree is checked.

Next, in S150, S110 to S150 are repeated while reducing the maximum significance value by 1 until the maximum significance value max_snf is smaller than the minimum significance value min_snf.

Figure 7:
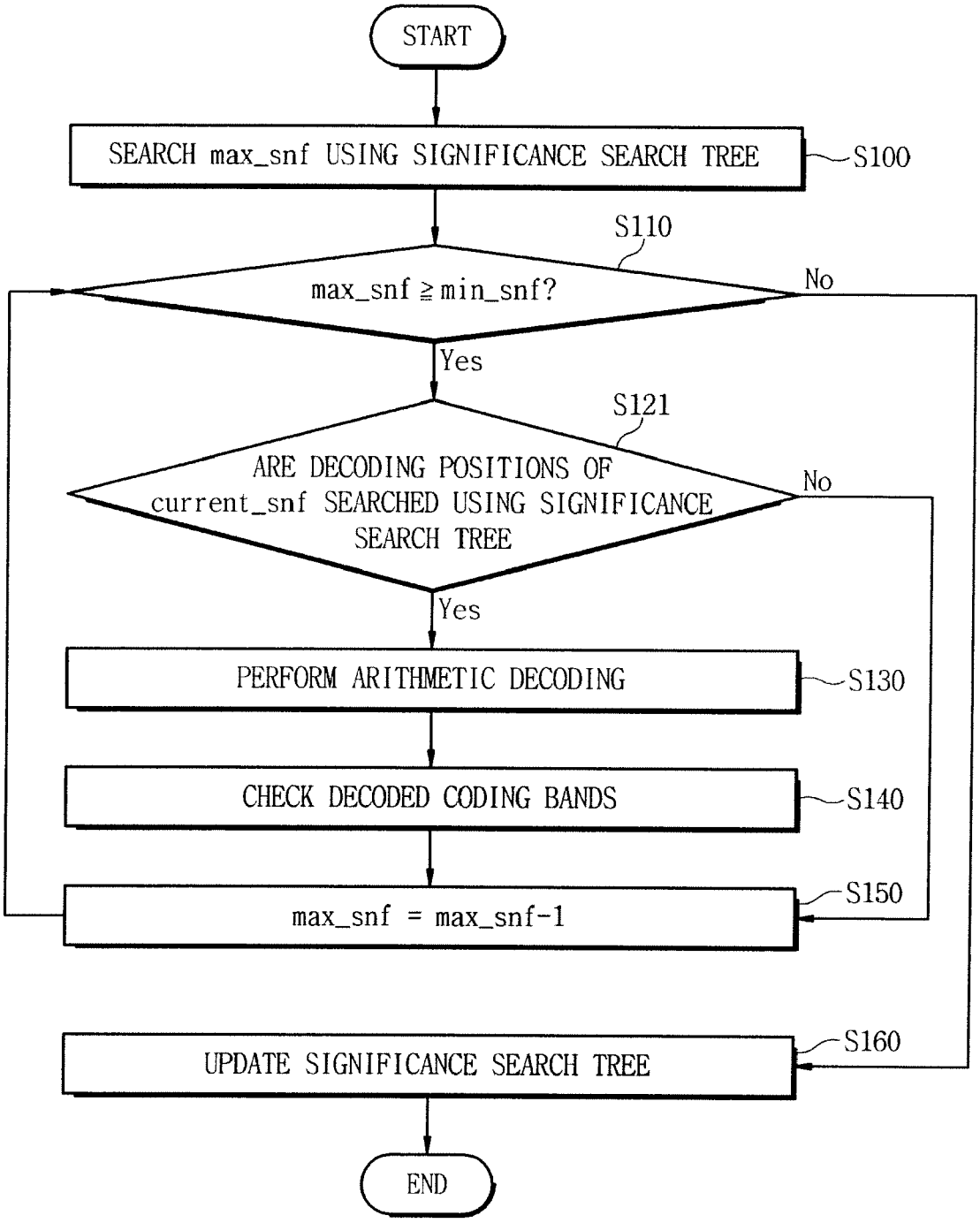
FIG. 7 is a flowchart illustrating an audio decoding method according to another embodiment of the present invention.

FIG. 7 is a flowchart illustrating an audio decoding method according to another embodiment of the present invention.

First, in S1100, the maximum significance value max_snf of a reference layer that is one of a base layer to a target layer using the significance search tree in units of coding bands. In S110, the maximum significance value max_snf is compared with the minimum significance value min_snf to determine whether the arithmetic decoding is to be performed.

When the maximum significance value max_snf is larger than or equal to the minimum significance value min_snf, the process proceeds to S121 so that the decoding positions of symbols are searched while comparing the current significance values current_snf of the symbols that belong to the reference layer with the maximum significance value max_snf using the significance search tree.

Then, it is determined whether the arithmetic decoding is required for the current layer in accordance with the search result. Even when the arithmetic decoding is required by the maximum significance value max_snf, the current significance values current_snf of the coefficients of the symbols are examined to determine whether the arithmetic decoding is required. When it is determined that the arithmetic decoding is required, the process proceeds to S130. When it is determined that the arithmetic decoding is not required, the process proceeds to S150.

When the maximum significance value max_snf is smaller than the minimum significance value min_snf, the process proceeds to S160 so that the significance search tree is updated for the coding bands on which the arithmetic decoding is performed in each frame.

Next, in S130, after the arithmetic decoding is performed on the symbols in units of the coding bands, in S140, the coding bands on which the arithmetic decoding is performed are checked so that a coding band range for updating the significance search tree is checked.

Next, in S150, S110 to S150 are repeated while reducing the maximum significance value by 1 until the maximum significance value max_snf is smaller than the minimum significance value min_snf.

Figure 8:
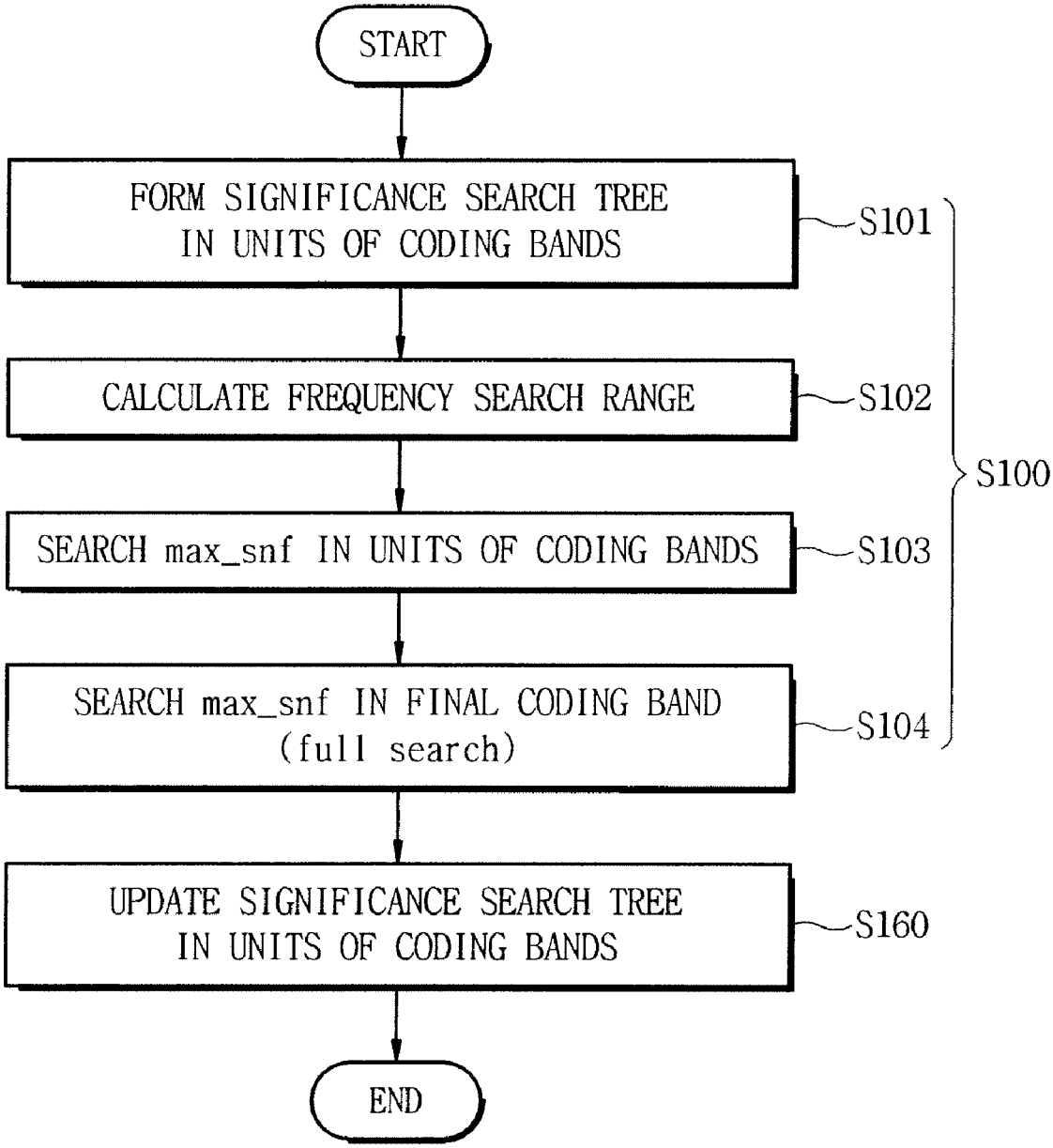
FIG. 8 is a flowchart illustrating a partial process of FIG. 6 or 7 in detail.

FIG. 8 is a flowchart illustrating a partial process of FIG. 6 or 7 in detail, in which S100 is illustrated in detail.

Referring to FIG. 8, S100 may be divided into S101 of forming a significance search tree in units of coding bands, S102 of calculating a frequency search range, S103 of searching the maximum significance value max_snf in units of the coding bands, and S104 of searching the maximum significance value max_snf in the final coding band using the full search method.

That is, in S100 of FIG. 6 or 7, the maximum significance value max_snf of each layer is obtained using the significance search tree and the full search method for a predetermined frequency search range full_search_range (refer to description performed with reference to FIG. 5).

At this time, the amount of calculations per a frame is obtained by multiplying the sum of the number of coding bands cband_range of each layer and the frequency search range full_search_range to which the full search method is applied, the number of channels, the number of window groups window_group, and the number of layers by each other.

While this invention has been particularly shown and described with reference to embodiments thereof, it will be understood by those skilled in the art that various changes in form and details may be made therein without departing from the spirit and scope of the invention as defined by the appended claims.

Since the above-described embodiments are provided to fully convey the concept of the invention to those skilled in the art, this invention should not be construed as being limited to the embodiments.

In the apparatus for decoding audio data and the method thereof according to the embodiments of the present invention, it is possible to reduce the amount of calculations that are performed during the arithmetic decoding of an audio signal in the BSAC to 1/16 of the amount of calculations of the conventional full search method so that it is possible to improve the performance of a decoder and to reduce cost.

What is claimed is:

1. An apparatus for decoding audio signal coded to have a layer structure so that a bit rate can be controlled from a base layer to a target layer, the apparatus comprising:

a bit plane decoder for decoding side information of the audio signal on each layer to obtain the current significance values of symbols that belong to each layer and for decoding the symbols in units of coding bands in the order of from the symbol composed of the uppermost bits to the symbol composed of the lowermost bits with reference to the maximum significance value of each layer to obtain quantization samples; and an operating unit for binding the current significance values in units of the coding bands to form a significance search tree in units of the coding bands and to obtain the maximum significance value of each layer using the significance search tree.

2. The apparatus as claimed in claim 1, further comprising:

an inverse quantizing unit for inverse quantizing the quantization samples based on the side information to restore the inverse quantized quantization samples to an audio signal of an original size;

a frequency/time mapping unit for converting the restored audio signal from a frequency domain to a time domain; and a frame buffer in which the significance search tree is stored and updated.

3. The apparatus as claimed in claim 1, wherein the operating unit obtains the maximum significance value of each layer using the significance search tree and a full search method for a predetermined frequency search range.

4. The apparatus as claimed in claim 3, wherein the amount of calculations per a frame that are performed by the operating unit is obtained by multiplying the sum of the number of coding bands of each layer and the frequency search range to which the full search method is applied, the number of channels, the number of window groups, and the number of layers by each other.

5. The apparatus as claimed in claim 1, wherein, in the bit plane decoding unit, differential decoding is performed on the side information and arithmetic decoding is performed on the symbols.

6. A method of decoding an audio signal coded to have a layer structure so that a bit rate can be controlled from a base layer to a target layer, the method comprising:

obtaining the maximum significance value of a reference layer that is one of the base layer to the target layer using a significance search tree in units of coding bands of the coded audio signal;

comparing, by a decoding apparatus, the maximum significance value with the minimum significance value to determine whether arithmetic decoding is to be performed;

searching, by the decoding apparatus, the decoding positions of the symbols while comparing the current significance values of the symbols that belong to the reference layer with the maximum significance value when it is determined that the maximum significance value is larger than or equal to the minimum significance value;

performing, by the decoding apparatus, arithmetic decoding on the symbols in units of the coding bands;

checking coding bands on which the arithmetic decoding is performed to update the significance search tree; and repeating the obtaining of the maximum significance value of a reference layer to the checking of coding bands on which the arithmetic decoding is performed while reducing the maximum significance value by 1 until the maximum significance value is smaller than the minimum significance value.

7. The method as claimed in claim 6, wherein, in the searching the decoding positions of the symbols, the searching uses the significance search tree.

8. The method as claimed in claim 6, wherein, in the obtaining of the maximum significance value of a reference layer, the maximum significance value of each layer is obtained using the significance search tree and a full search method for a predetermined frequency range.

9. The method as claimed in claim 8, wherein, in the obtaining of the maximum significance value of a reference layer, the amount of calculations per a frame is obtained by multiplying the sum of the number of coding bands of each layer and the frequency search range to which the full search method is applied, the number of channels, the number of window groups, and the number of layers by each other.

* * * * *